US006644731B2

(12) United States Patent
Tang

(10) Patent No.: US 6,644,731 B2
(45) Date of Patent: Nov. 11, 2003

(54) LOCKABLE, COLLAPSIBLE CHILDREN'S PATIO CHAIR

(76) Inventor: Larry Tang, 45 Park Knoll Dr., East Brunswick, NJ (US) 08816

( * ) Notice: Subject to any disclaimer, the term of this patent is extended or adjusted under 35 U.S.C. 154(b) by 0 days.

(21) Appl. No.: 10/036,886

(22) Filed: Jan. 4, 2002

(65) Prior Publication Data

US 2003/0127885 A1 Jul. 10, 2003

(51) Int. Cl.[7] ..... A47C 4/48
(52) U.S. Cl. ..... 297/16.2; 297/45
(58) Field of Search ..... 135/28, 37; 297/16.2, 297/16.1, 21, 42, 45

(56) References Cited

U.S. PATENT DOCUMENTS 3,635,520 A * 1/1972 Roher et al. ..... 297/45
4,610,364 A * 9/1986 Meade ..... 211/183
4,770,467 A * 9/1988 Zinn ..... 297/423.37
5,570,928 A * 11/1996 Staunton et al. ..... 297/232
5,882,068 A * 3/1999 Levine ..... 297/21
5,893,605 A * 4/1999 Chang ..... 297/188.14
5,984,406 A * 11/1999 Lee ..... 297/16.2
6,039,403 A * 3/2000 Hargroder ..... 297/440.24
6,231,119 B1 * 5/2001 Zheng ..... 297/16.2
6,237,993 B1 * 5/2001 Zheng ..... 297/16.2
6,302,479 B1 * 10/2001 Zheng ..... 297/16.2

* cited by examiner

*Primary Examiner*—Peter M. Cuomo
*Assistant Examiner*—Stephen D'Adamo
(74) *Attorney, Agent, or Firm*—Charles I. Brodsky

(57) ABSTRACT

A patio chair incorporating frame having pairs of crossed front, rear and side legs, and with front and rear connectors for stabilizing the chair or lounger when opened and for collapsing the chair to a compact package when closed, and with compressible pins and slide locks on the side legs to be captured by snap action in forming a positive locking securement against accidental closing, and against forced closing by small children.

14 Claims, 12 Drawing Sheets

LOCKABLE, COLLAPSIBLE CHILDREN'S PATIO CHAIR

BACKGROUND OF THE INVENTION

1. Field of the Invention

This invention relates to foldable chairs, in general, and to a collapsible children's patio chair especially useful for casual seating, in particular.

2. Description of the Related Art

Folding or collapsible chairs in the nature of furniture have been described in such U.S. Pat. No. as No. 3,635,520 (Roher et al) and No. 5,984,406 (Lee). In a multiple seat arrangement, they are also described in U.S. Pat. No. 5,570, 928 (Staunton et al). For outdoor use, in camping and watching sports games, chairs of this type have been illustrated in U.S. Pat. No. 5,893,605 (Chang). When a reclining chair is desired for camping, hiking, fishing, and concert events, a construction of the type shown in U.S. Pat. No. 5,882,068 (Levine) is said to be useful.

While chairs of these types may prove adequate to suit their intended purposes, their acceptability depends in large part upon their strength and reliability of operation. In these two areas, the folding chair of the Lee Patent (No. 5,984, 406) falls somewhat short.

A significant improvement of these collapsible chairs is described in my pending United States Patent Application, entitled Collapsible Patio Chair, filed Apr. 28, 2000 as Ser. No. 09/561,339, now U.S. Pat. No. 6,322,13. However, the patio chair of the present invention goes one step further by being particularly attractive for use by children, in having the folding chair automatically locked in place once it is opened. The added safety feature which results will be seen to follow whether the patio chair be provided with an armrest—as in my Ser. No., 09/561,339 Application, or whether it be provided without an armrest.

SUMMARY OF THE INVENTION

As will become clear from the following description, the lockable, collapsible children's patio chair of the invention consists of a frame including pairs of front crossed legs and rear crossed legs, and two pairs of side crossed legs, with each pair of crossed legs being pivotally connected together where they cross; first and second front pad connectors pivotally connected to lower ends of one of the front crossed legs and one of the side crossed legs, respectively; first and second rear pad connectors pivotally connected to lower ends of one of the rear crossed legs and the other of the side crossed legs, respectively; first and second front connectors pivotally connected to upper ends of the one front crossed leg and the other of the side crossed legs, respectively; first and second rear connectors pivotally connected to upper ends of the rear crossed legs and the one side crossed leg, respectively; a pair of side supports passing though apertures in each of the first and second rear connectors having lower ends fixedly connected to the rear pad connectors; and a fabric liner connected to the first and second front connectors and to upper ends of the pair of side supports.

To provide strength and reliability of operation beyond that characterizing the patented Lee design, the front connectors of the frame include a top surface having a notch therein open at one end and slightly larger than the diameter of the front crossed legs when composed as a tubular configuration, a first wall at an underside thereof defining one side of the notch and to which the upper ends of the front crossed legs are pivotally connected and a second wall at the underside, generally perpendicular to the first wall and combined therewith, to which the upper ends of the other of the side crossed legs are also pivotally connected. In like manner, each of the front and rear connector pads (as well as the rear connectors) include the two generally perpendicular walls for fastening with their respective pivotally connected legs—while the rear connector pads include apertures at the join of the two walls where the side supports are fixed.

In accordance with a particular aspect of the present invention, a compressible pin or snap button is included on one leg of at least one pair of side crossed legs to fit within an aperture in a slidable lock; that lock additionally includes a pivot connection to one end of a provided reinforcing bar, an opposite end of which is similarly pivotally connected to the other leg of that pair of side crossed legs. The end result is that a positive locking securement follows—whether the collapsible chair be provided with, or without armrests. Whereas such lock is preferably incorporated to slide downwardly along the one side leg as the chair is folded open, it will be readily apparent to those skilled in the art that the orientation can be reversed—so that the lock can slide upwardly to reach the position of securement—again, either for the patio chair design with an armrest inclusion, or without such implementation. And, as will be seen, the orientation can be such as to position the lock, once secure, adjacent to any or all of the front and rear pad connectors of the construction when slid downwardly—or adjacent to either or both front connectors if slid upwardly.

BRIEF DESCRIPTION OF THE DRAWINGS

These and other features of the present invention will be more clearly understood from a consideration of the following description, taken in connection with the accompanying drawings, in which:

FIG. 12 is a front perspective view of the patio chair of FIG. 10 in its unfolded position, with the seating fabric in place;

FIG. 13 and 15A–15C are views helpful in an understanding of the captive locking securement of the collapsible chair once unfolded, according to the invention.

DETAILED DESCRIPTION OF THE INVENTION

Figure 1:
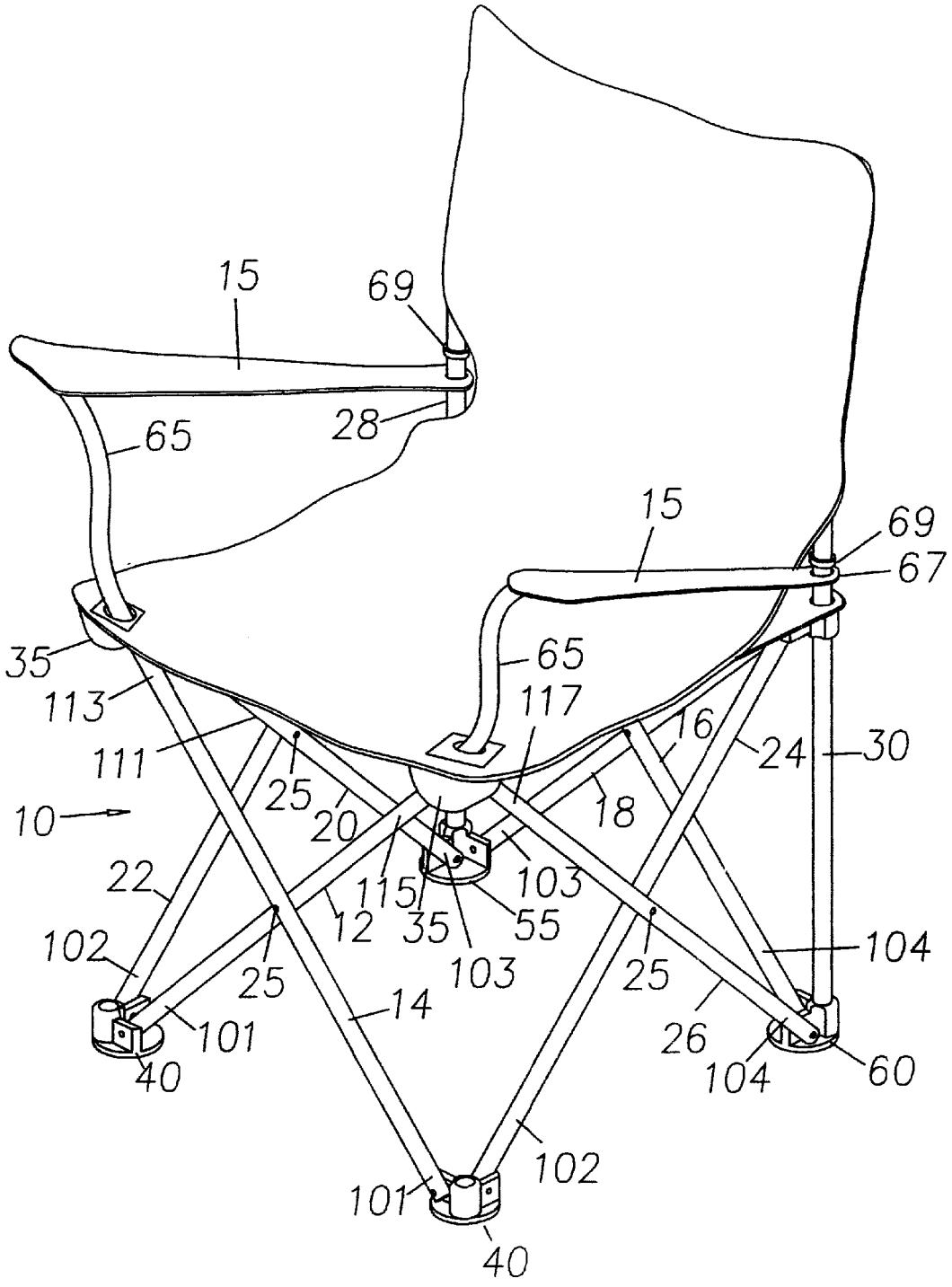
FIG. 1 is a front perspective view of the collapsible patio chair of my Ser. No. 09/561,339 Application, in its unfolded position, helpful in an understanding of the present invention.

As with the folding chair of my application Ser. No. 09/561,339, the collapsible children's patio chair of the present invention is constructed of tubular members. In particular, the frame of the patio chair 10 includes eight crossed legs in pairs of two each—front legs 12, 14, rear legs 16, 18, and side legs 20, 22 and 24, 26. As illustrated, each of the pairs 12 & 14, 16 & 18, 20 & 22 and 24 & 26 are joined together by pivot pins 25. The frame 10, furthermore, includes a pair of side supports 28, 30—which, like the crossed legs 12 & 14, 16 & 18, 20 & 22 and 24 & 26 are tubular, and are constructed of aluminum or steel.

A pair of front connectors 35 join the crossed legs 14 & 20 and 12 & 26 together at their upper ends. A pair of front pad connectors 40 join the crossed legs 12 & 22 together, as well as the crossed legs 14 & 24, at their bottom ends. Similarly, two rear connectors 45, 50 respectively connect the upper ends of crossed legs 16 & 22 and 18 & 24 at their upper ends. Two rear pad connectors 55, 60 respectively join the lower ends of the crossed legs 18 & 20 and 16 & 26. As shown in FIGS. 1–4, the side supports 28, 30 respectively extend downwardly through apertures 33, in the rear connectors 45, 50, to fix with the rear pad connectors 55 and 60 without pivoting. With the patio chair to be constructed with armrests (FIGS. 1 and 2), each front leg 12, 14 is provided with an extension 65 that extends upwardly through the front connectors 35 and bends outwardly to form a front support 66 where it is secured, as by a screw, with a sleeve at a front underside of a fabric armrest (15, in FIG. 1), at the rear of which a grommet 67 on the fabric encircles the side supports 28, 30, and where it is restricted in upwards movement by a ring 69 on the supports 28, 30. As with the armrests of my application Ser. No. 09/561,339, the armrest 15 provides a support for the user's arm, as well as a manner to fold and unfold the chair with adequate leverage.

Particularly referring to FIGS. 1–2, 5A & 5B, and 6A & 6B, the lower end 101 of the crossed legs 12 & 14 are fastened by rivet or other pivot manner to the front wall 84 of the front pad connector 40 shown as having a generally perpendicular side wall 83, the fastener passing through its aperture 86A. Similarly, the lower end 102 of the crossed legs 22 & 24 is also fastened by rivet, or other pivot to the wall 83, by means of its aperture 86B. As illustrated, both front pad connectors 40 are identical, with one of the lower ends 101 being pivoted on one surface of the front wall 84, with the other one of the lower ends 101 being on the opposite surface of the front wall 84, and with the two lower ends 102 being pivoted on opposing faces of the side wall 83.

Figure 6B:
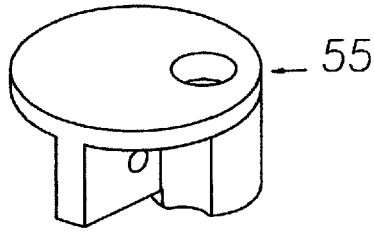
Figure 5A:
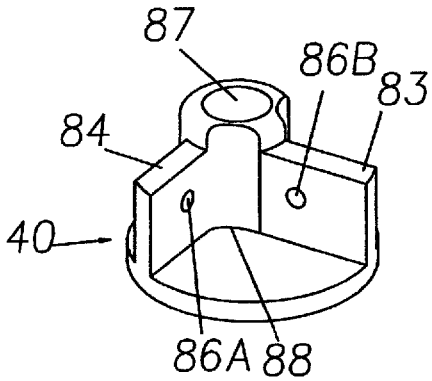
Figure 6A:
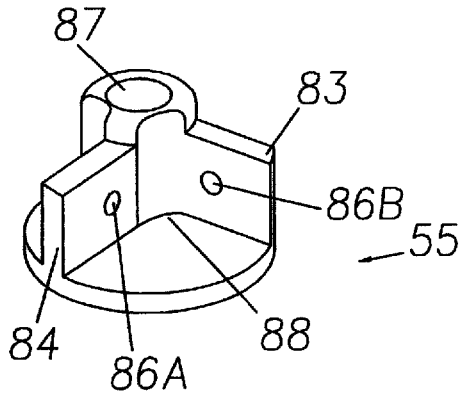
Figure 7A:
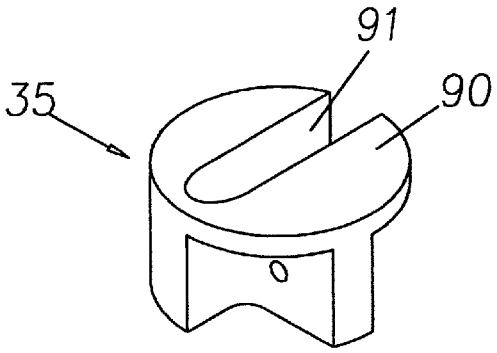
FIGS. 7A & 7B and 8A & 8B are top and bottom perspective views respectively of the front connectors of the collapsible patio chair of FIG. 1.
Figure 7B:
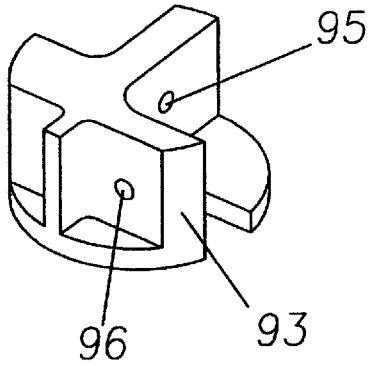
Figure 8A:
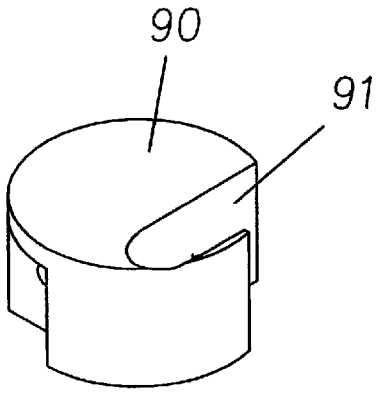
Figure 8B:
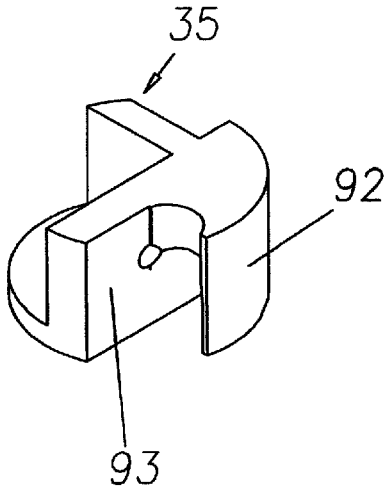

In like manner, the lower end 103 of the crossed legs 18 & 20 and the lower end 104 of the crossed legs 16 & 26 are fastened by rivets, or other pivots to the rear pad connectors 55, 60 respectively, with the rear pad connector 55 being of the configuration shown in FIGS. 6A & 6B, and with the rear pad connector 60 being of the configuration shown in FIGS. 6A & 6B rotated 90 counterclockwise. Each of the connectors 55, 60 thus include their own pairs of generally perpendicular walls and their own apertures. As indicated, the lower end 103 of leg 20 is fastened by pivot or otherwise to rear pad connector 55 at one surface of the wall 84 via aperture 86A while the lower end 103 of leg 18 is fastened by pivot or otherwise to one surface of the wall 83 via aperture 86B. Correspondingly, the lower end 104 of leg 26 is fastened to the opposing surface of wall 84 of connector 60 via aperture 86A, while the lower end 104 of leg 16 is fastened to the opposing surface of wall 83 via aperture 86B. In accordance with the construction, apertures 87 are included at the joinings 88 of the walls 83, 84 of the connectors 55, 60 to receive the lower ends of the side supports 28, 30, where they are fixed by rivets or otherwise, without pivoting. Although not receiving side supports, the front pad connectors 40 may be constructed with a similar aperture 87 at the joinings 88 of their walls 83, 84, to allow for a common construction of these front and rear pad connectors and an interchangeability of components, although such apertures 87 at the front pad connectors are not needed for operation of the collapsible patio chair.

The upper end 111 of leg 20 and the upper end 113 of leg 14 are fastened together in front connector 35 in manner identical to the fastening in connector 35 of upper end 115 of leg 12 and upper end 117 of leg 26. The connectors 35 are illustrated in FIGS. 7A & 7B and 8A & 8B—with the configurations of FIGS. 7A & 7B receiving the legs 12 and 26, and with the configuration of FIGS. 8A and 8B receiving the legs 14 and 20. As shown, the connectors 35 include a top surface 90 having a notch therein 91 open at one end, understood to be slightly larger than the diameter of the crossed legs 12, 14 when composed as a tubular configuration. This dimensioning allows the legs 12, 14 to glide easily within the notch 91 as the patio chair is folded closed or opened. As more particularly shown in FIGS. 7B and 8B, the front connectors 35 further include a first wall 92 at an underside defining one side of the notch 91 and to which the legs 14 and 12 are fastened. At the same time, the connectors 35 include a second wall 93 at the underside, generally perpendicular to the wall 92 in combination therewith, to which the upper ends 111 and 117 of the crossed legs 20 and 26 are fastened. In similar manner, both perpendicular walls 92, 93 are provided with apertures 95, 96 for fastening with their respective pivotally connected legs.

Figure 2:
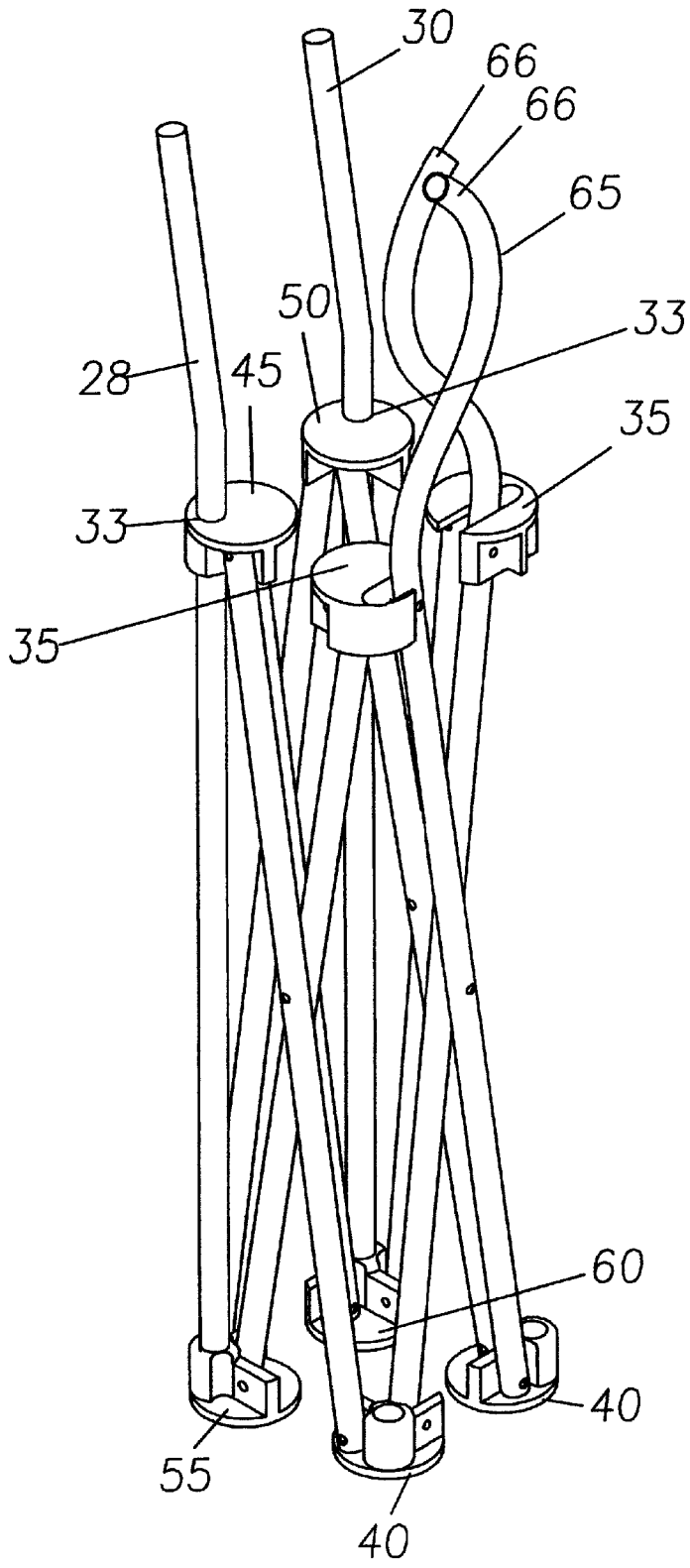
FIG. 2 is a front perspective view of such patio chair when fully collapsed, with the seating fabric removed, ready for storage.
Figure 3:
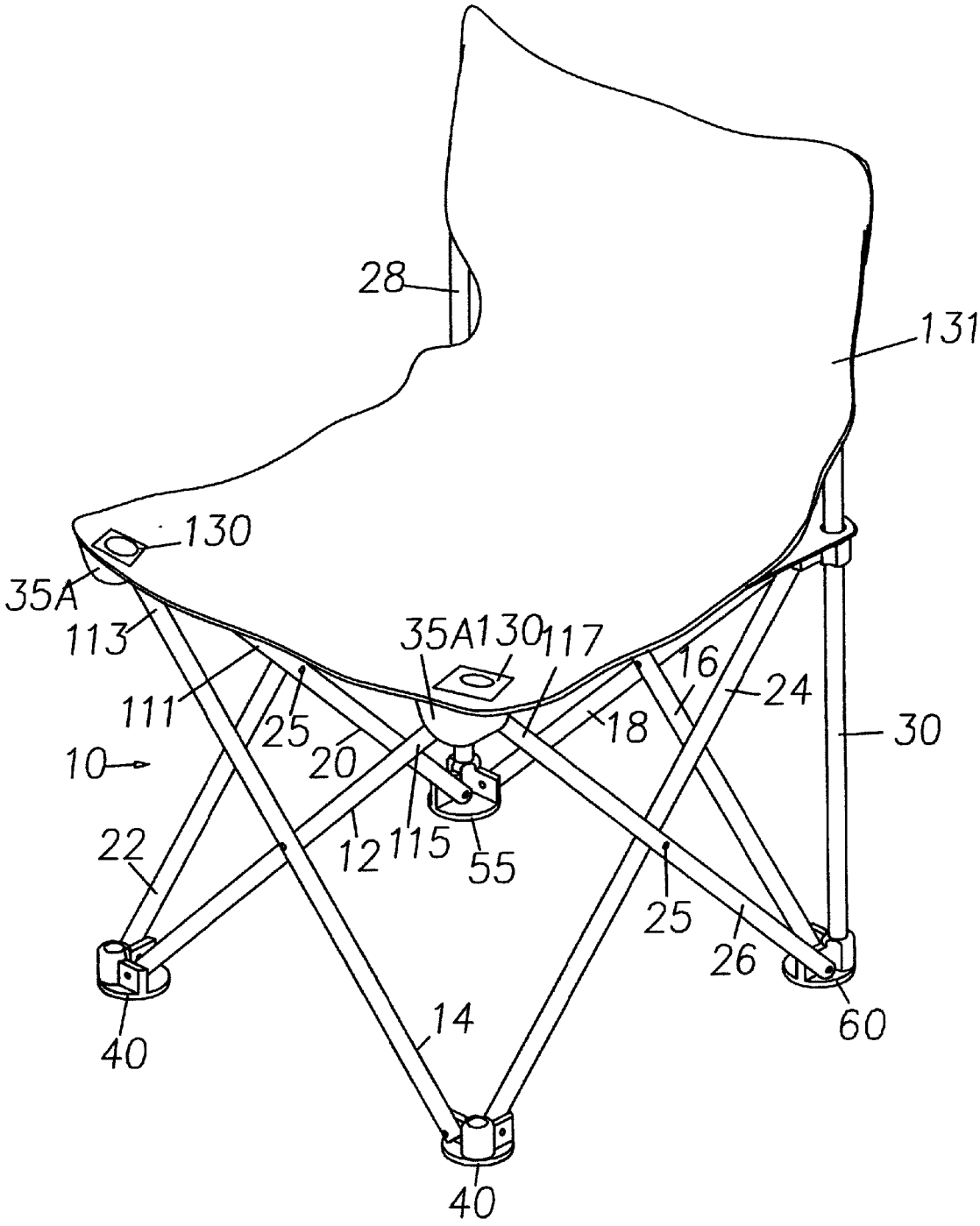
FIG. 3 is a front perspective view of a second collapsible patio chair in its unfolded position with which the teachings of the present invention—as with the collapsible patio chair of FIG. 1 is particularly attractive.
Figure 4:
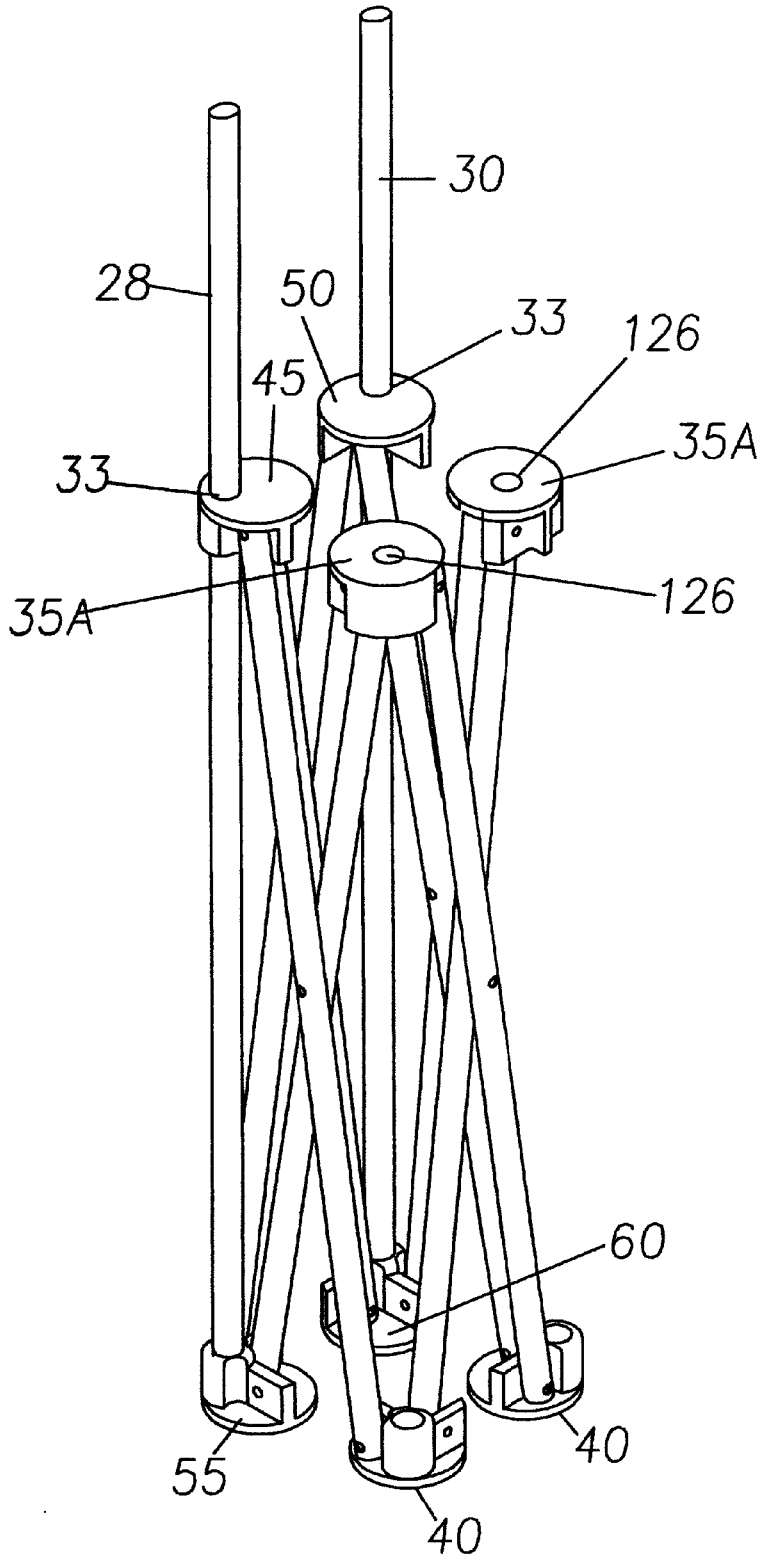
FIG. 4 is a front perspective view of the patio chair of FIG. 3 when fully collapsed, without the seating fabric, ready for storage.
Figure 5B:
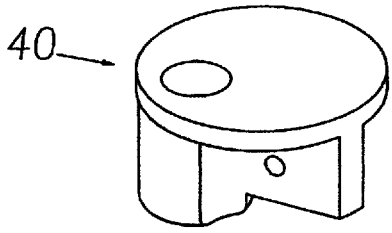
FIGS. 5A & 5B and 6A & 6B are top and bottom perspective views respectively of the front and rear pad connectors of the collapsible patio chairs of FIGS. 1 and 3.

As so far described, except for the front connectors 35 of FIGS. 1 and 2, and of FIGS. 7A, 7B, 8A and 8B, the collapsible patio chair of FIGS. 3 and 4 without the armrest 15 is identical to the collapsible patio chair of FIGS. 1 and 2 where the armrest 65 is included.

Figure 9A:
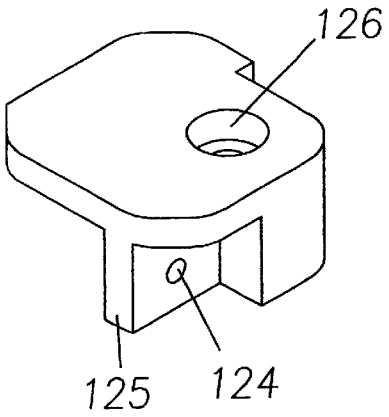
FIGS. 9A & 9B, 12 and 13 are varieties of perspective views of various component parts of the collapsible patio chair of the invention which allow the chair to be unfolded open and folded closed.
Figure 9B:
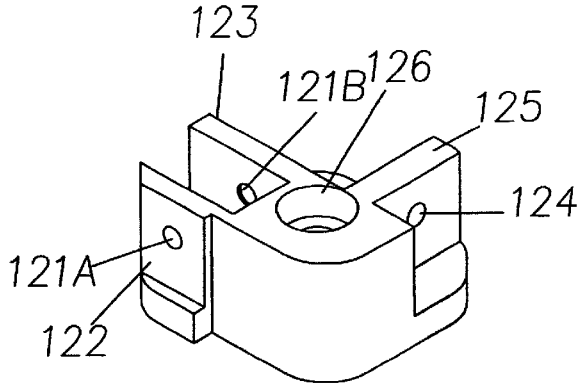

With the patio chair of FIGS. 3 and 4, the upper end 111 of leg 20 and the upper end 113 of leg 14 are fastened together in front connector 35A in a manner identical to the fastening in connector 35A of upper end 115 of leg 12 and upper end 117 of leg 26. The connectors 35A are illustrated in FIGS. 9A and 9B with one of the legs (20 or 12) being fastened through the apertures 121A and 121B of two parallel walls 122, 123, and with the other of the legs (14 or 26) being fastened through the aperture 124 of the perpendicular wall 125. The aperture 126 will be understood as receiving a screw or like fastener extending upwardly through the connector 35A to join with a cap 130 which holds the fabric liner 131 of the chair in place along the front of the seat (FIG. 3).

Figure 10:
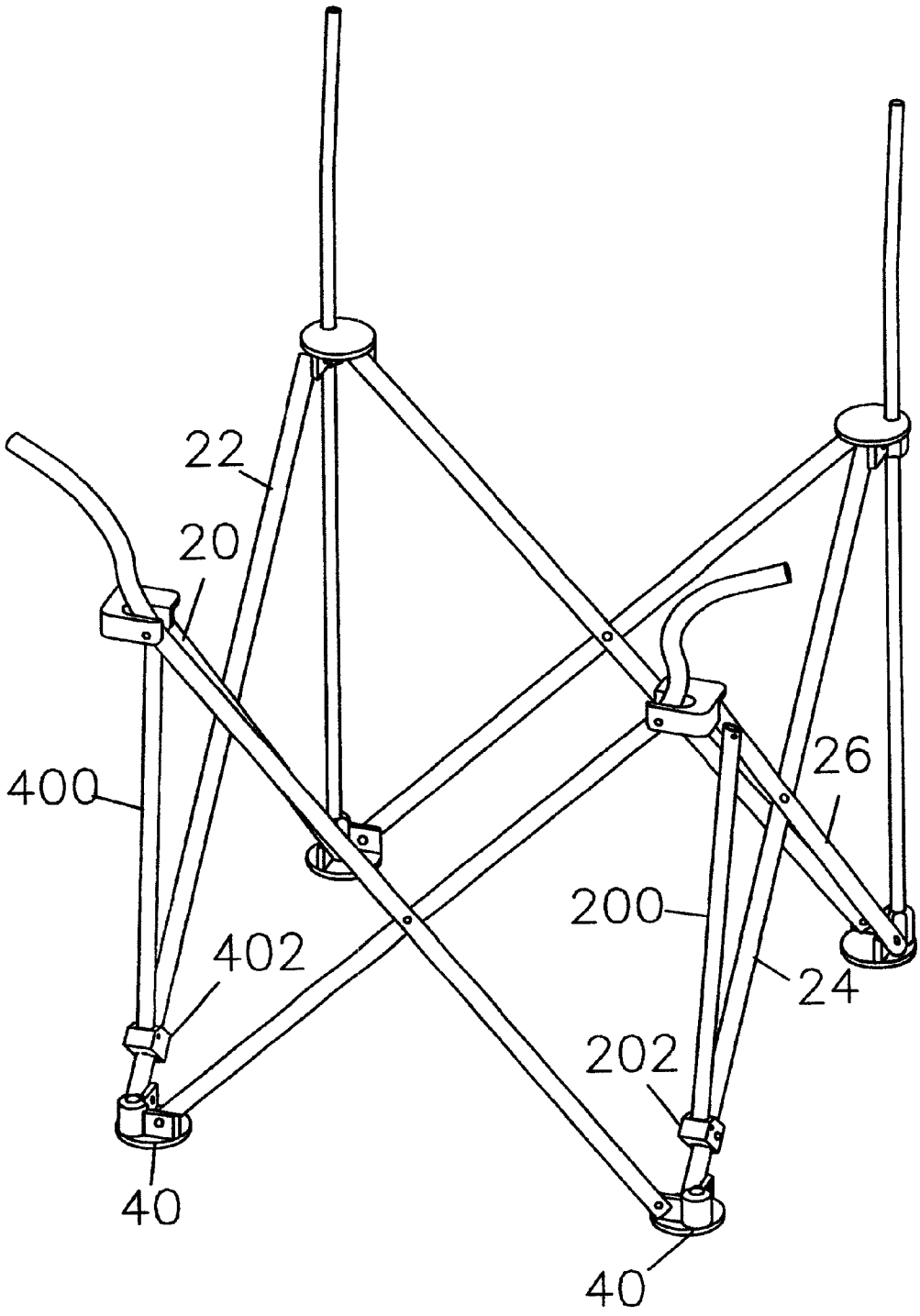
FIG. 10 is a front perspective view of the lockable, collapsible children's patio chair according to one aspect of the invention in its unfolded position designed for armrests although with the seating fabric removed.
Figure 11:
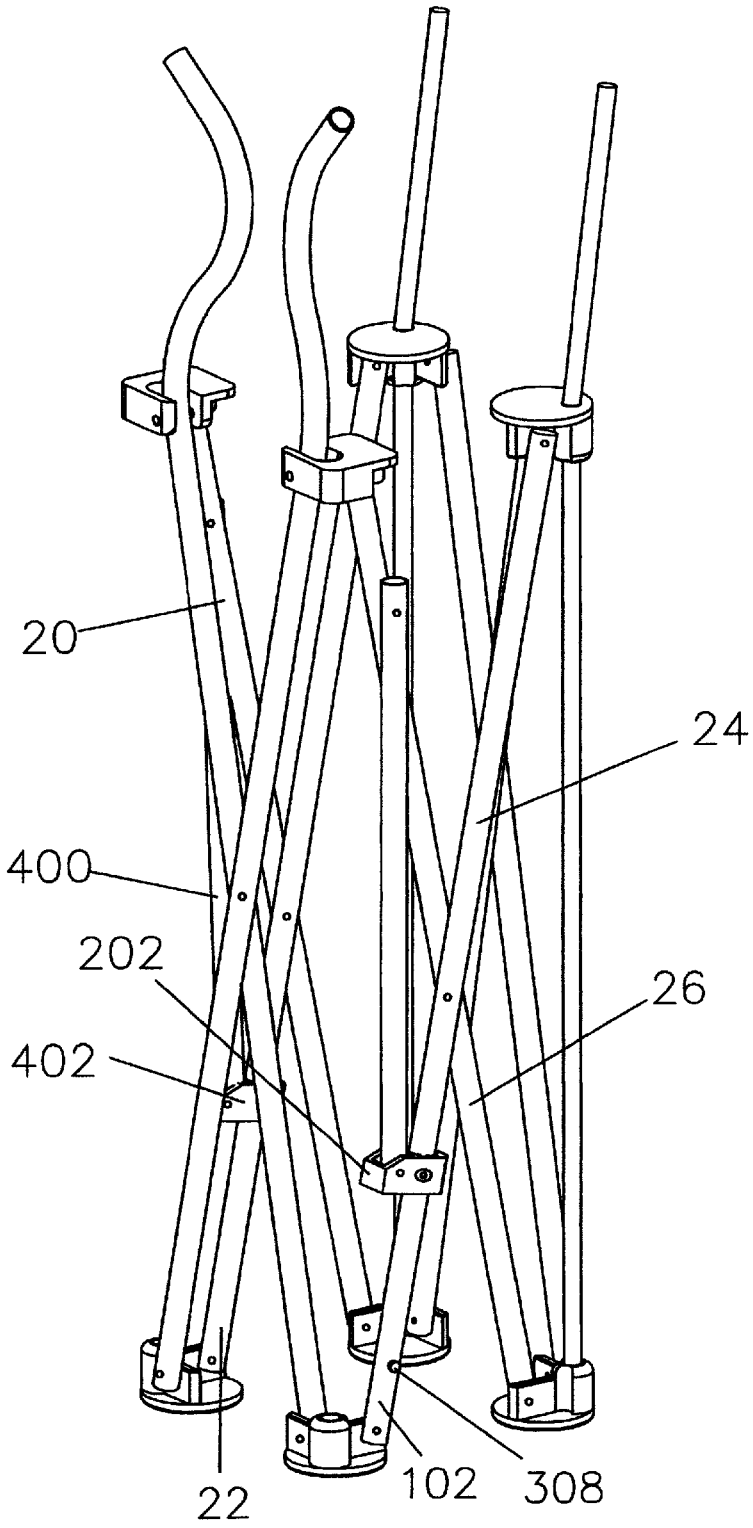
FIG. 11 is a front perspective view of the lockable, collapsible children's patio chair of FIG. 10 in its folded position, also without any seating fabric in place.
Figure 12:
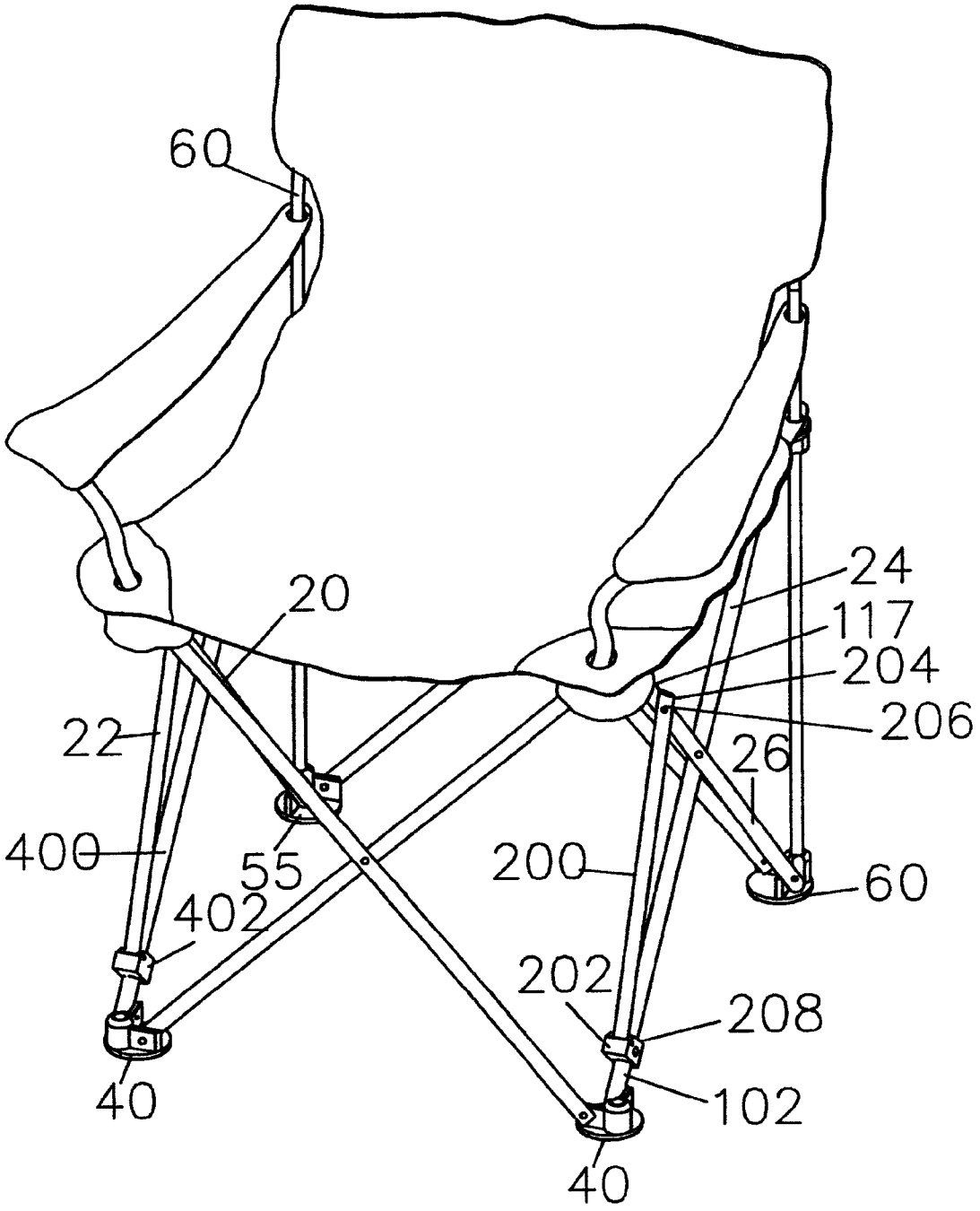
Figure 13:
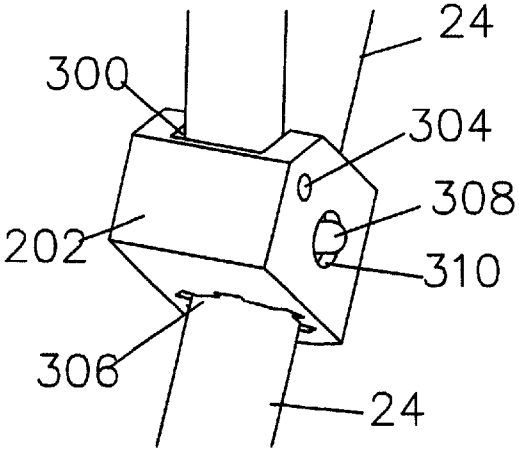

The improvement of the present invention for the collapsible children's patio chair—either with or without the armrest—, can be understood from the views of FIGS. 10 and 11 for the patio chair of FIG. 1, folded open and collapsed closed, respectively, with the seating fabric or liner removed. FIG. 12, on the other hand, shows the improvement with the liner in place for the open chair. In particular, in accordance with the invention, a reinforcement bar 200 is added, along with a slidable lock 202. The upper end 204 of reinforcing bar 200 is pivotally connected (as by rivet) at 206 with upper end 117 of side crossed leg 26 while its lower end 208 seats within an aperture 300 of the lock 202, where it is pivotally connected as at 304 (FIG. 13). The lock 202 includes a further aperture 306 to receive the side crossed leg 24 along which the lock 202 is arranged to slide downwardly when the patio chair is opened to the position shown in FIGS. 10 and 12, and arranged to slide upwardly to the position shown in FIG. 11. As more clearly shown in FIG. 11, adjacent the lower end 102 of side crossed leg 24 a compressible pin or snap button 308 is added, to fit within an aperture 310 in the lock 202. By sliding the lock 202 downwardly along side crossed leg 24, a point eventually is reached at which the lock receives the compressible pin 308 in its aperture 310 in effecting the securement. Depressing the pin 308 effectively releases the lock so that it may slide upwardly to the position shown in FIG. 11 when collapsing the patio chair, with the pin 308 then being freed.

As will be appreciated by those skilled in the art, even a further positive locking securement could be had to the patio chair of FIG. 1 by including a second reinforcing bar 400 and a second slidable lock 402 adjacent the left front pad connector 40 of FIG. 1, just as it is shown adjacent the right side front pad connector 40 in FIG. 12. In such configuration, the reinforcing bar 400 pivotally connects to upper end 111 of side crossed leg 20 while the lock 402 slides along side crossed leg 22.

As will further be appreciated, the slidable lock of the invention could be implemented not only adjacent the right or left-front pad connectors of the patio chair as in FIG. 12, but adjacent the rear pad connectors 55 or 60, or adjacent to all of them individually or collectively. All that would be required would be the inclusion of further reinforcing bars pivotally connected to one of the side crossed legs, and with the lock mechanism slidable upwardly and downwardly along the other side crossed leg of the pair. In other words, one, two, three or four such reinforcing bar-slidable lock configurations could be employed with the collapsible chair, secured with its own compressible pin or snap button 308 in providing the securement, as the case may be. And, whatever the number of lock arrangements that are employed, and wherever they may be used, the aperture 310 continues to capture the compressible pin 308 by snap action to form the positive locking securement needed when the patio chair is to be employed by a small child in such respect, the resistance of the compressible pin(s) 308 can be selected not only to hold the patio chair in its unfolded position, but to prevent against accidental, or even forceful attempts by the child to close the patio chair for storage. And, such action will be seen to follow in similar manner not only for the patio chair with its armrest (FIG. 1), but also with respect to the patio chair without the armrest (FIG. 3). In such manner, the reinforcing bar serves as a "locking bar" for the chair construction.

Figure 14:
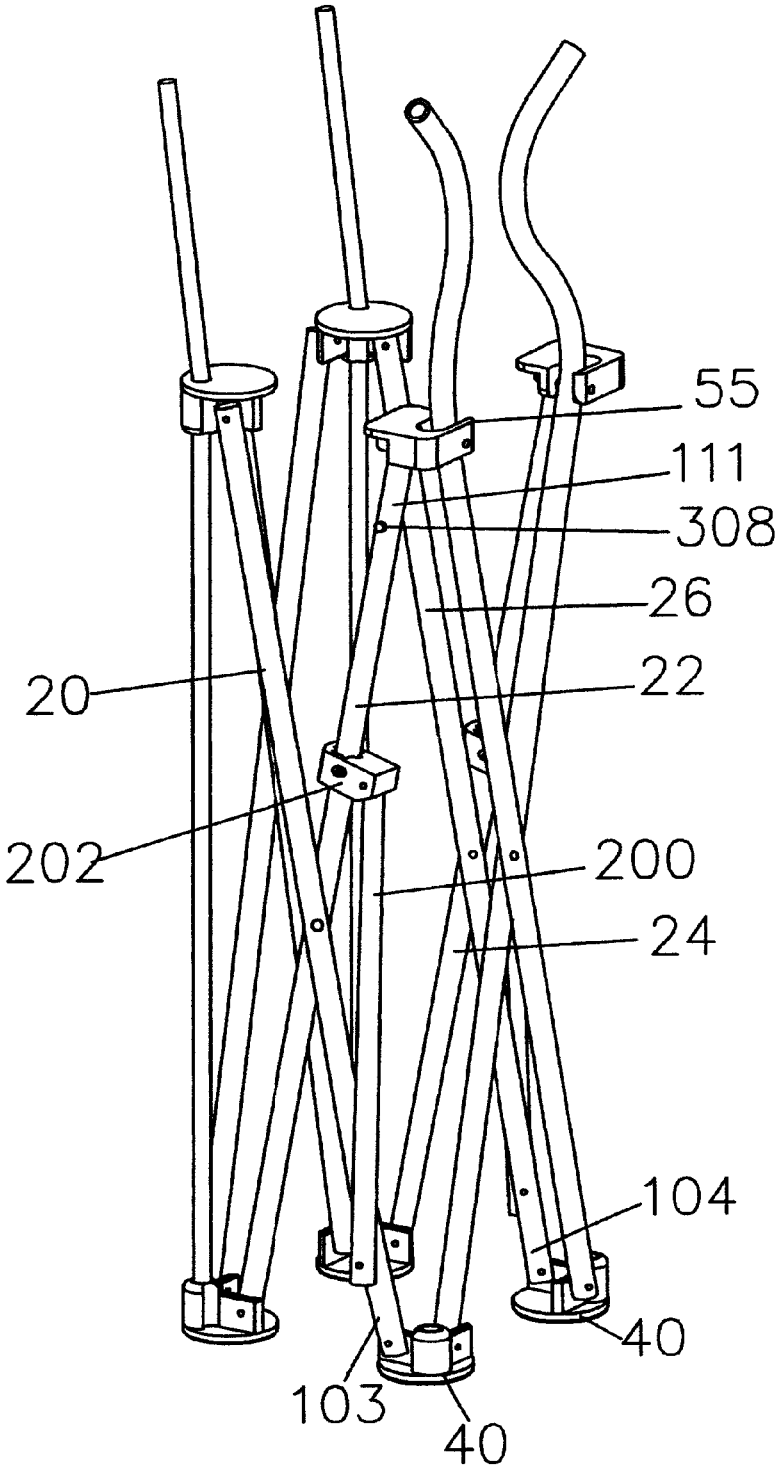
FIG. 14 is a front perspective view of the lockable children's patio chair according to a second aspect of the invention in its folded position, also without any seating fabric.

FIG. 14, on the other hand, shows the collapsed patio chair of FIG. 2 (i.e., with the armrest but without the seat liner) with the orientation of the lock 202 and reinforcing bar 200 reversed. As shown in FIG. 14, the compressible pin or snap button 308 is located at the upper end 111 of the side leg 22, adjacent the left side front connector 35 instead of adjacent to the left side front pad connector 40. The reinforcing bar 200 continues to fit within the slidable lock 202, but, in this embodiment, it is pivotally connected adjacent the lower end 103 of side crossed leg 20. Here, unfolding the patio chair slides the lock 202 upwardly until such time as the aperture 310 again receives the pin or snap button 308. As also shown in FIG. 14, a second such slidable lock can be incorporated to upwardly slide along side crossed leg 24 with a reinforcing bar pivotally connected adjacent lower end 104 of side crossed leg 26 in much the same manner as two such slide locks are shown in FIG. 11. Once again, opening the collapsible chair secures it in position to prevent accidental or forceful attempts at closure with a child occupant.

Figure 15C:
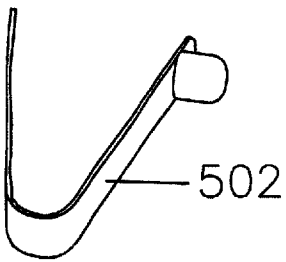
Figure 15B:
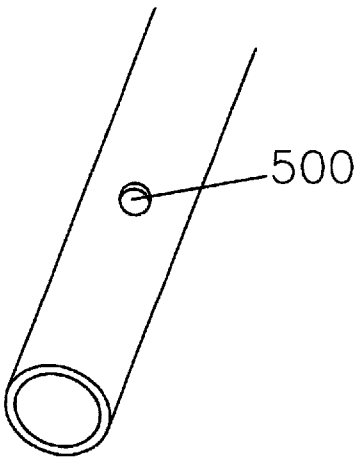
Figure 15A:
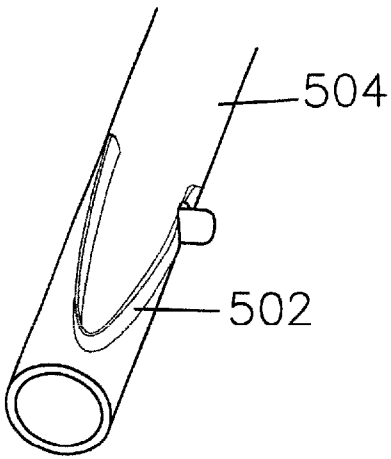

As will be understood, other types of locking securements can be had besides a compressible pin or snap button. FIGS. 15*a*–15*c*, for example, show an aperture 500 in the side crossed leg, with a V-shape clip 502 within a track inside the leg 504 to extend therethrough, and automatically join with the lock once the chair is forced to open. The configuration of FIGS. 15*a*–15*c* will thus be seen to be substitutable for the compressible pin or snap button of FIGS. 10–14. As with the construction of FIGS. 10–12, one, two or more locking clips of FIG. 15 could be employed—either for the patio chair construction with the armrests, or without the armrests, whichever may be desired.

In the embodiments of FIGS. 10–15, furthermore, it will be appreciated that the placement of the compressible pin, snap button or clip is preferably at a position corresponding to the height when the chair is unfolded for use. With the leg connectors of the chair being of a plastic construction, their tubing configuration will then snap the pin, the button, etc. into the aperture of the lock in providing the desired securement. In this respect, the chair can be protected against accidental closing, or against a child's own devices in trying to fold the chair to the stored position once folded open.

While there have been described what are considered to be preferred embodiments of the present invention, it will be readily appreciated by those skilled in the art that modifications can be made without departing from the scope of the teachings herewith. Thus, for example, while the invention has been described in the context of a collapsible patio chair, it will be apparent that the types of locking arrangements set out could be employed equally as well with the construction of the casual lounger described in my pending United States Patent Application entitled Collapsible Cot, filed Jun. 15, 2000 as Serial No. 09/593,938, now U.S. Pat. No. 6,364,410. Additionally, while the restraining bar of each locking mechanism is shown as essentially vertically between the individual crossed legs of the pair of side crossed legs, it will be understood that the orientation could also be arranged so that the restraining bar could extend horizontally—simply by placing the lock and the collapsible pin, button or clip in cooperating alignment to maintain the crossed legs spread apart once the chair or lounger is folded open. For at least such reasons, therefore, resort should be had to the claims appended hereto for a true understanding of the invention.

I claim:

1. A collapsible chair comprising:

a frame including pairs of front crossed legs and rear crossed legs, and two pairs of side crossed legs, with each pair of crossed legs being pivotally connected together where they cross;

first and second front pad connectors pivotally connected to lower ends of one of said front crossed legs and one of said side crossed legs, respectively;

first and second rear pad connectors pivotally connected to lower ends of one of said rear crossed legs and the other of said side crossed legs, respectively;

first and second front connectors pivotally connected to upper ends of said one front crossed leg and said other of said side crossed legs, respectively;

first and second rear connectors pivotally connected to upper ends of said rear crossed legs and said one of said side crossed legs, respectively;

a pair of side supports passing through apertures in each of said first and second rear connectors having lower ends fixedly connected to said rear pad connectors;

a fabric liner connected to said first and second front connectors and to upper ends of said pair of side supports; and a first locking mechanism coupled between individual crossed legs of one pair of said two pairs of side crossed legs, slidable in one direction for securing said frame in an opened position and slidable in an opposite direction for releasing said frame to a collapsed position.

2. The collapsible chair of claim 1, also including a second locking mechanism coupled between individual crossed legs of the other pair of said two pairs of side crossed legs, also slidable in one direction for securing said frame in an opened position and slidable in an opposite direction for releasing said frame to a collapsed position.

3. The collapsible chair of claim 2, wherein each of said first and second locking mechanisms include a lock slidable to seat adjacent to one of said front pad connectors and said rear pad connectors when said chair is folded open.

4. The collapsible chair of claim 2, wherein each of said first and second locking mechanisms include a lock slidable to seat remote from one of said front pad connectors and said rear pad connectors when said chair is folded closed.

5. The collapsible chair of claim 1, wherein said first locking mechanism is coupled between a lower end of one side crossed leg and an upper end of the other side crossed leg of said one of said two pairs of side crossed legs.

6. The collapsible chair of claim 5, also including a second locking mechanism coupled between a lower end of one side crossed leg and an upper end of the other side crossed leg of said other of said two pairs of side crossed legs.

7. The collapsible chair of claim 6, wherein said second locking mechanism includes a lock slidable on one leg of said other of said pairs of side crossed legs, an aperture to receive a collapsible pin at a lower end of said one leg, and a pivot connection to one end of a second included reinforcing bar, an opposite end of which is pivotally connected to an upper end of said other leg of said other of said pair of side crossed legs.

8. The collapsible chair of claim 6, wherein said second locking mechanism includes a lock slidable on one leg of said other of said pairs of side crossed legs, an aperture to receive a collapsible pin at an upper end of said one leg, and a pivot connection to one end of a second included reinforcing bar, an opposite end of which is pivotally connected to a lower end of said other leg of said other of said pair of side crossed legs.

9. The collapsible chair of claim 5, wherein said first locking mechanism includes a lock slidable on one leg of said one of said pairs of side crossed legs, an aperture to receive a collapsible pin at a lower end of said one leg, and a pivot connection to one end of an included first reinforcing bar, an opposite end of which is pivotally connected to an upper end of said other leg of said one of said pairs of side crossed legs.

10. The collapsible chair of claim 5, wherein said first locking mechanism includes a lock slidable on one leg of said one of said pairs of side crossed legs, an aperture to receive a collapsible pin at an upper end of said one leg, and a pivot connection to one end of an included first reinforcing bar, an opposite end of which is pivotally connected to a lower end of said other leg of said one of said pairs of side crossed legs.

11. The collapsible chair of claim 5, wherein said first locking mechanism includes a lock slidable on one leg of said one of said pairs of side crossed legs, an aperture to receive a snap button in a lower end of said one leg, and a pivot connection to one end of an included first reinforcing bar, an opposite end of which is pivotally connected to an upper end of said other leg of said one of said pairs of side crossed legs.

12. The collapsible chair of claim 5, wherein said first locking mechanism includes a lock slidable on one leg of said one of said pairs of side crossed legs, an aperture to receive a snap button in an upper end of said one leg, and a pivot connection to one end of an included first reinforcing bar, an opposite end of which is pivotally connected to a lower end of said other leg of said one of said pairs of side crossed legs.

13. The collapsible chair of claim 1, wherein said first locking mechanism includes a lock slidable to seat adjacent to one of said front pad connectors and said rear pad connectors when said chair is folded open.

14. The collapsible chair of claim 1, wherein said first locking mechanism includes a lock slidable to seat remote from one of said front pad connectors and said rear pad connectors when said chair is folded closed.

* * * * *